US007004081B2

(12) United States Patent
Chang

(10) Patent No.: US 7,004,081 B2
(45) Date of Patent: Feb. 28, 2006

(54) COMPUTER DESK

(76) Inventor: Wu-De Chang, No. 27, Alley 43, Lane 192, Sec. 1, Dong-Shan Rd., Tai-Chung City (TW)

( * ) Notice: Subject to any disclaimer, the term of this patent is extended or adjusted under 35 U.S.C. 154(b) by 400 days.

(21) Appl. No.: 10/379,450

(22) Filed: Mar. 4, 2003

(65) Prior Publication Data

US 2004/0173125 A1 Sep. 9, 2004

(51) Int. Cl.
*A47B 37/00* (2006.01)

(52) U.S. Cl. ..... 108/50.01; 312/223.3

(58) Field of Classification Search ..... 108/50.01, 108/50.02, 180, 153.1, 108, 23; 312/195, 312/196, 223.6, 223.3, 194; 248/188.1, 188
See application file for complete search history.

(56) References Cited

U.S. PATENT DOCUMENTS 4,066,023 A * 1/1978 Hughes ..... 108/50.01
4,838,177 A * 6/1989 Vander Park ..... 108/155
5,186,425 A * 2/1993 Keusch et al. ..... 248/188.1
5,287,815 A * 2/1994 Gross ..... 108/50.14
5,357,873 A * 10/1994 Hilton ..... 108/50.01
5,522,324 A * 6/1996 van Gelder et al. ..... 108/50.02
5,568,773 A * 10/1996 Hung ..... 108/50.02
5,638,759 A * 6/1997 Klugkist ..... 108/50.02
5,704,298 A * 1/1998 Corpuz et al. ..... 108/50.01
6,152,048 A * 11/2000 Vander Park ..... 108/50.02
6,398,326 B1 * 6/2002 Wang ..... 312/223.3
6,786,161 B1 * 9/2004 Fischer ..... 108/50.01
6,810,820 B1 * 11/2004 Okerlund et al. ..... 108/147

* cited by examiner

*Primary Examiner*—Jose V. Chen
(74) *Attorney, Agent, or Firm*—Charles E. Baxley

(57) ABSTRACT

The present disclosure discloses a computer desk, comprising a main desk; two side rods, vertically disposed at the side of the main desk; two adjusting members, respectively sheathed into the two side rods, and sliding along the side rod and being secured onto the said side rod; a loading board with one end coupled to an upper section of one of the adjusting members; a supporting stand having a threaded rod on one end and a slightly elevated Y-shape rod on the other end; the threaded rod with a screw nut being disposed in a through pipe at the external lower section of the adjusting member of the loading board, and the open end of the Y-shape rod being secured onto the bottom of the loading board; a side desk, movably foldable on a side of the main desk; and a side desk link rod having one end pivotally coupled to the exterior of another adjusting member, and the other end pivotally coupled to the bottom of the side desk.

15 Claims, 7 Drawing Sheets

COMPUTER DESK

BACKGROUND OF THE INVENTION

1. Field of the Invention

The present invention relates to a computer desk, more particularly to a computer desk having a side stand on both sides of the desk, wherein the height of one side stand is adjustable, and the other is foldable.

2. Description of the Related Art

As computer equipments change day after day, all kinds of new computer desks are introduced to the market. The design of computer desks particularly emphasizes on the practicality, convenience, multiple functions, comfort, and compliance to ergonomics, therefore there are various patterns and sizes. When users select computer desks, they usually select an appropriate desk according to their computer equipments, but the computer equipments change so fast, and the original computer desk no longer meets the demand in a very short time. It also occupies much space and wastes cost to buy another new desk. Therefore, the adjustability, variability, or expandability becomes one of the key points of computer desk design.

SUMMARY OF THE INVENTION

The primary objective of the present invention is to provide a computer desk having the adjustability and variability for users to change and arrange their computer desk according the change of computer equipments.

To achieve the above objectives, the technical measures taken for this invention comprises:

a main desk;

two side rods, each vertically disposed at a side of said main desk;

two adjusting members, respectively sheathing into said two side rods, and sliding along and secured onto said side rod;

a loading board with one end coupled to an upper section of one of said adjusting members;

a supporting stand comprising a threaded rod on one end and a slightly elevated Y-shape rod on the other end; said threaded rod with a screw nut being disposed in a through pipe at the external lower section of said adjusting member of the loading board, and the open end of said Y-shape rod being secured onto the bottom of said loading board.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
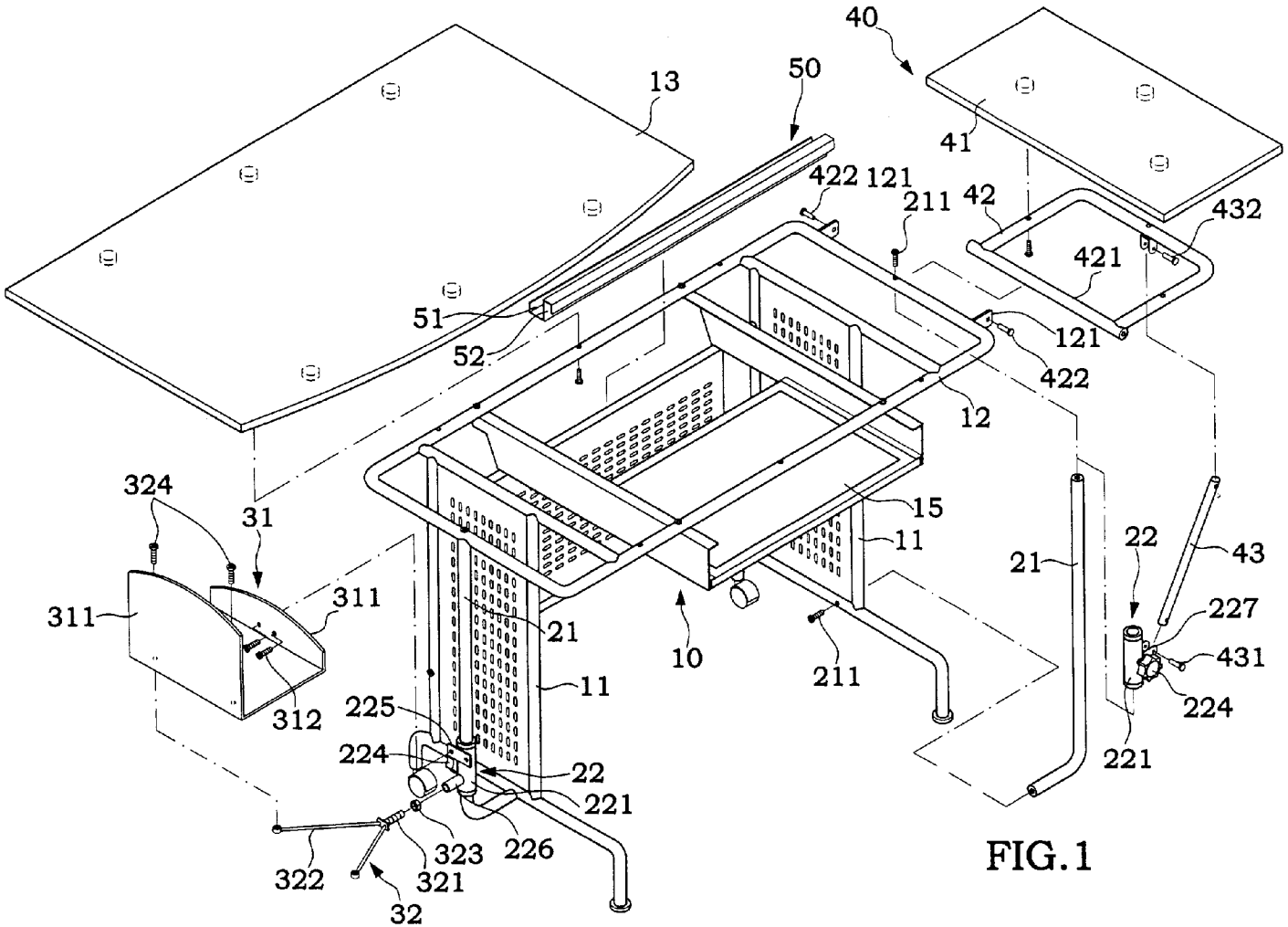
FIG. 1 is a perspective diagram of the disassembled structure of the computer desk according to the present invention.
Figure 2:
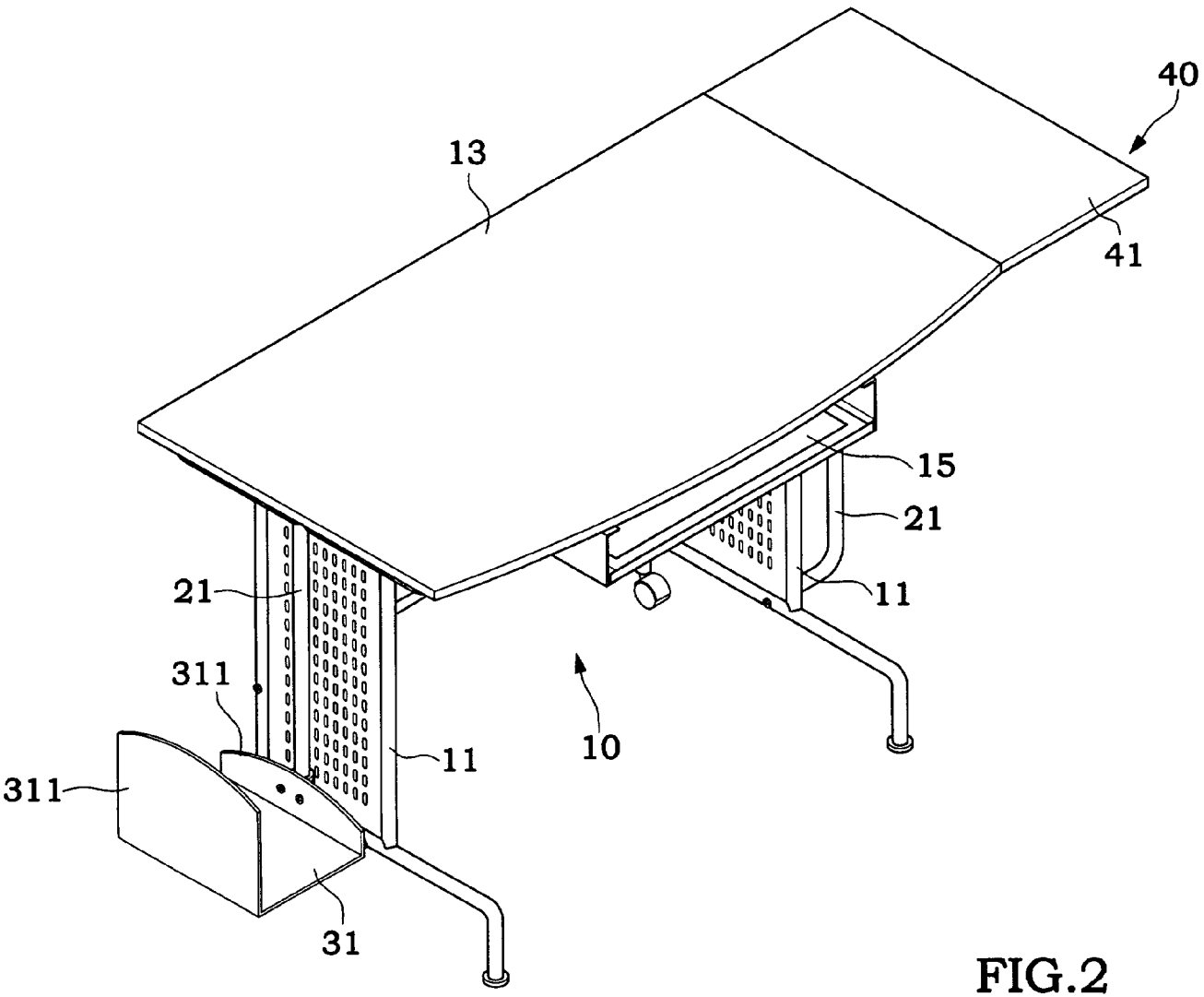
FIG. 2 is a perspective diagram of the assembled structure of the computer desk according to the present invention.
Figure 3:
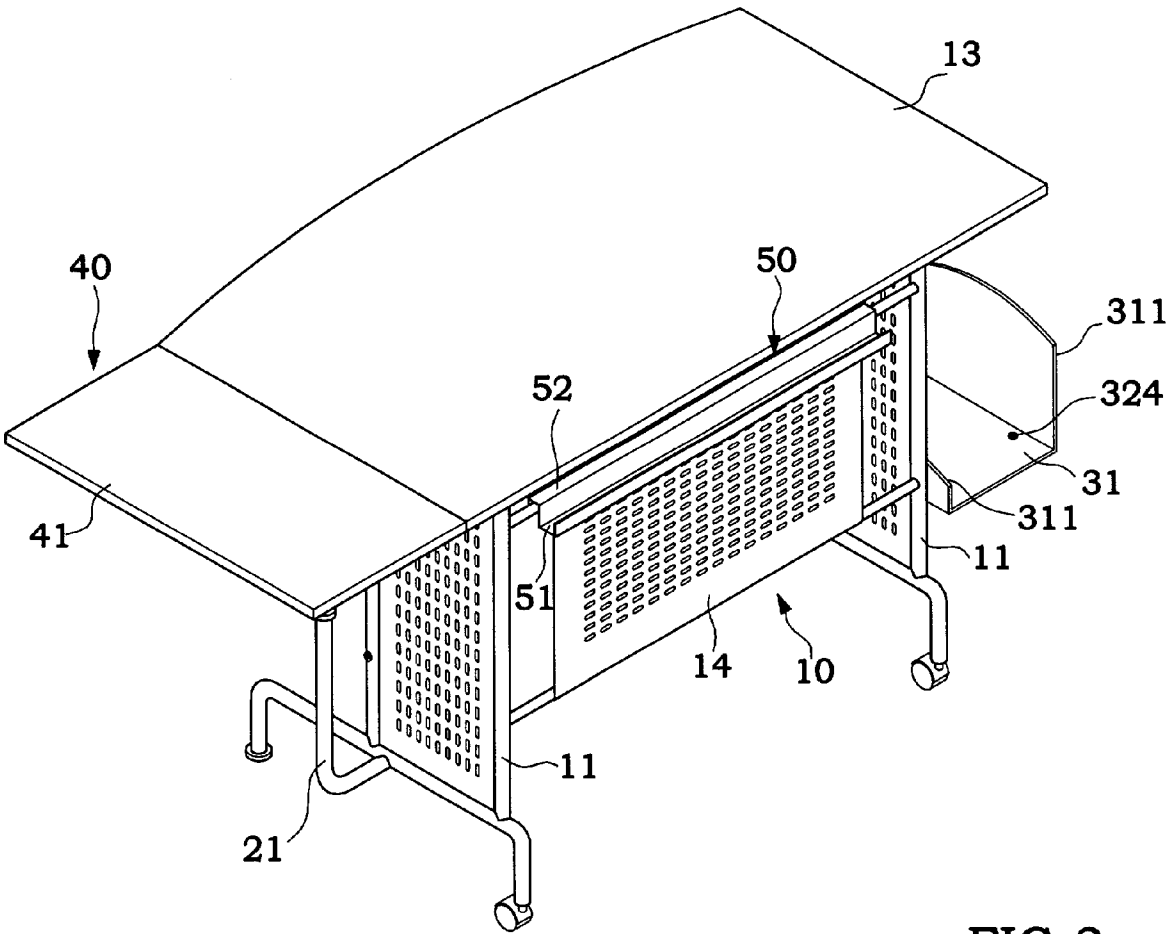
FIG. 3 is a rear-view diagram of the assembled structure of the computer desk according to the present invention.
Figure 4:
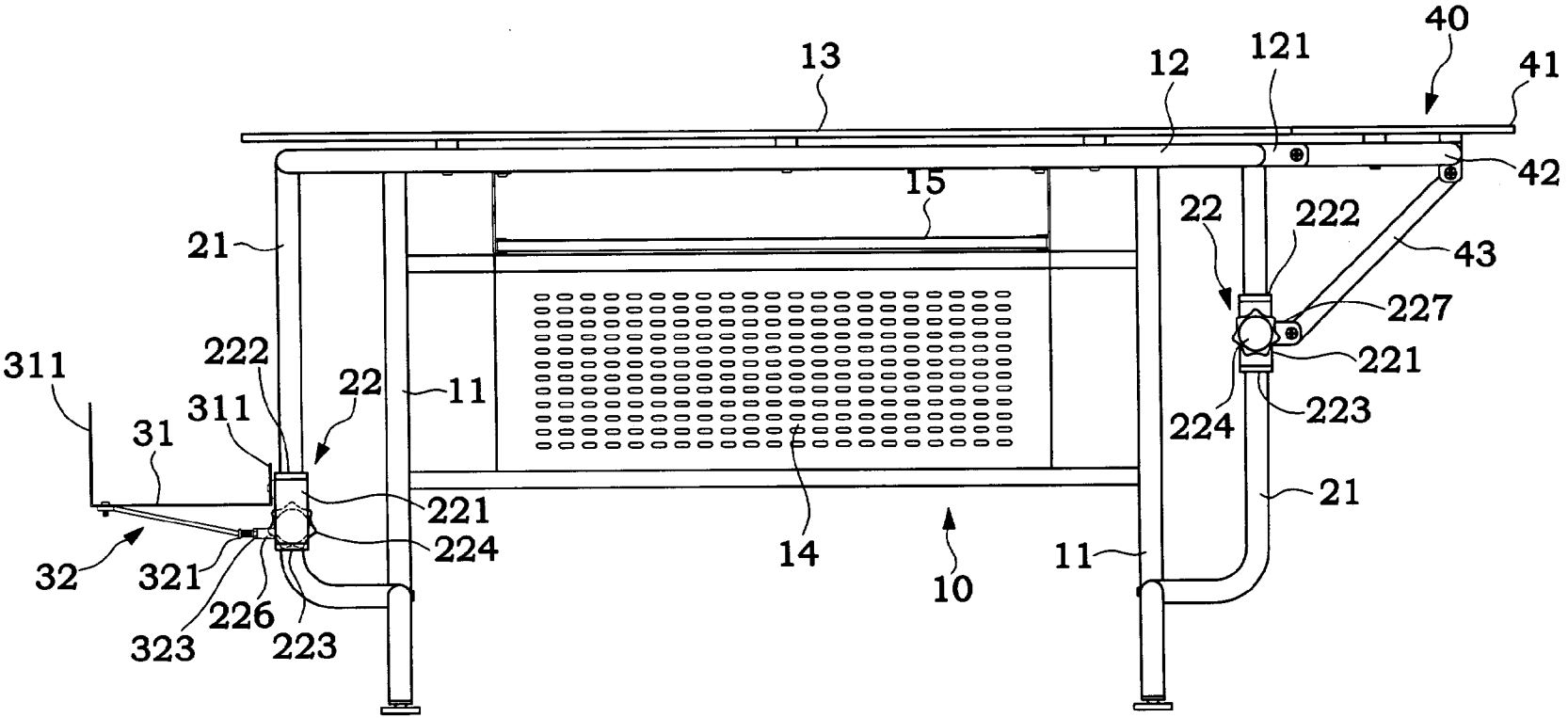
FIG. 4 is a front-view diagram of the assembled structure of the computer desk according to the present invention.
Figure 6:
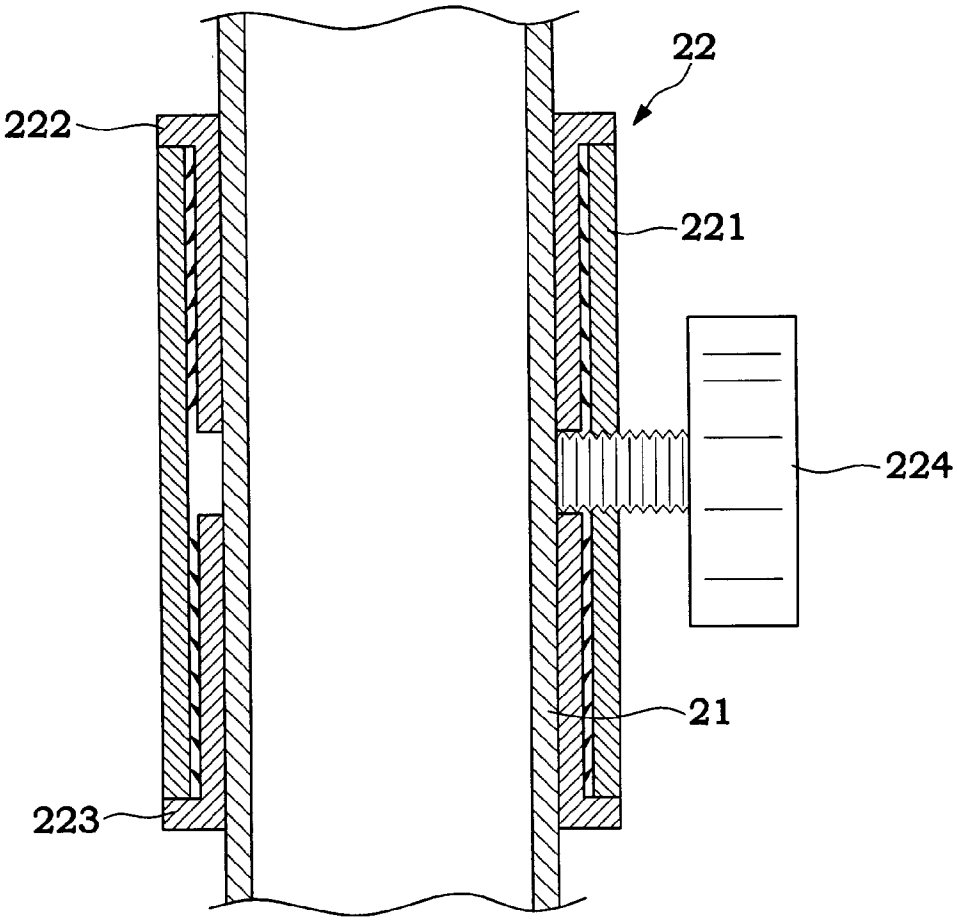
FIG. 6 is a cross-sectional diagram of the assembling of adjusting member and side rod according to the present invention.

The computer desk of the present invention, comprises:

a main desk 10, as shown in FIG. 1, comprising two side stands 11, a desktop frame 12 jointly supported by said side stands 1; a desk board 13 disposed above said desktop frame 12; a rear board 14 jointly coupled to the rear of said two side stands 11; and a keyboard tray 15 being disposed and capable of moving back and forth under said desktop frame 12;

two side rods 21, as shown in FIGS. 1 and 4, disposed on the sides of said main desk 10; the embodiment of the present invention using a plurality of screw members 211 to respectively secure both ends of said two side rods 21 to said desktop frame 12 and the bottom of said side stand 11;

two adjusting members 22, as shown FIGS. 1, 4, and 6, respectively sheathed onto said two side rods 21 and sliding along said side rod 21 or securing onto said side rod 21; said adjusting member 22 comprising a metal external cylinder 221; said external cylinder 221 comprising a wear-proof bushing 222, 223 at the upper and lower ends inside; said side rod 21 pivotally coupled to said wear-proof bushing 222, 223; an adjusting bolt 224 disposed along a radial direction of said external cylinder 221; and said bolt 224 passing through said external cylinder 221 such that its internal end pressing against the body of said side rod 21, and thus releasing the bolt 224 and moving the adjusting member 22 vertically along said side rod 21 and securing said bolt 224 at a desired position as well as securing said adjusting member 22 on the side rod 21; further, said external cylinder 221 being made of metal and thus its exterior being soldered with other components as needed;

a loading board 31, as shown in FIGS. 1 and 4, being an open form at the front and rear sections of said loading board 31, and having a vertical panel 311 at each of the left and right sections, wherein a panel 311 being secured to a fixed board 225 soldered outside said adjusting member 22;

a supporting stand 32, as shown in FIGS. 1 and 4, being a threaded rod 321 at one end, and a slightly elevated Y-shape rod 322 at the other end; said threaded rod 321 having a nut 323 pivotally coupled into a through pipe 226 outside said adjusting member 22, and the open end of said Y-shape rod 322 having a screw 324 secured to the bottom of said loading board 31;

a side desk 40, as shown in FIG. 1, disposed on a side of said desktop frame 12 and being foldable, and the embodiment of this invention using a pair of hinges 121 disposed on the side of said desktop frame 12; said side desk 40 having a desk frame 42 at the bottom of said desk board 41, and one frame rod 421 of said desk frame 42 being pivotally coupled between said pair of hinges 121 with a pivotal element 422;

a side desk link rod 43, as shown in FIGS. 1 and 4, with one end movably coupled to a pivotal clip 227 outside said adjusting member 22 with a pivotal element 431, and the other end pivotally coupled to a desk frame 42 of said desk 40 with a pivotal element 432; and a cable bar 50, as shown in FIGS. 1 and 3, being a bar structure with a curved cross-section, and such curved structure constituting a groove section 51 and a hanging section 52 of said cable bar 50; said hanging section 52 hooking a rear board 14 of said main desk 10, and said groove section 51 accommodating related cables of the computer equipment.

Figure 5:
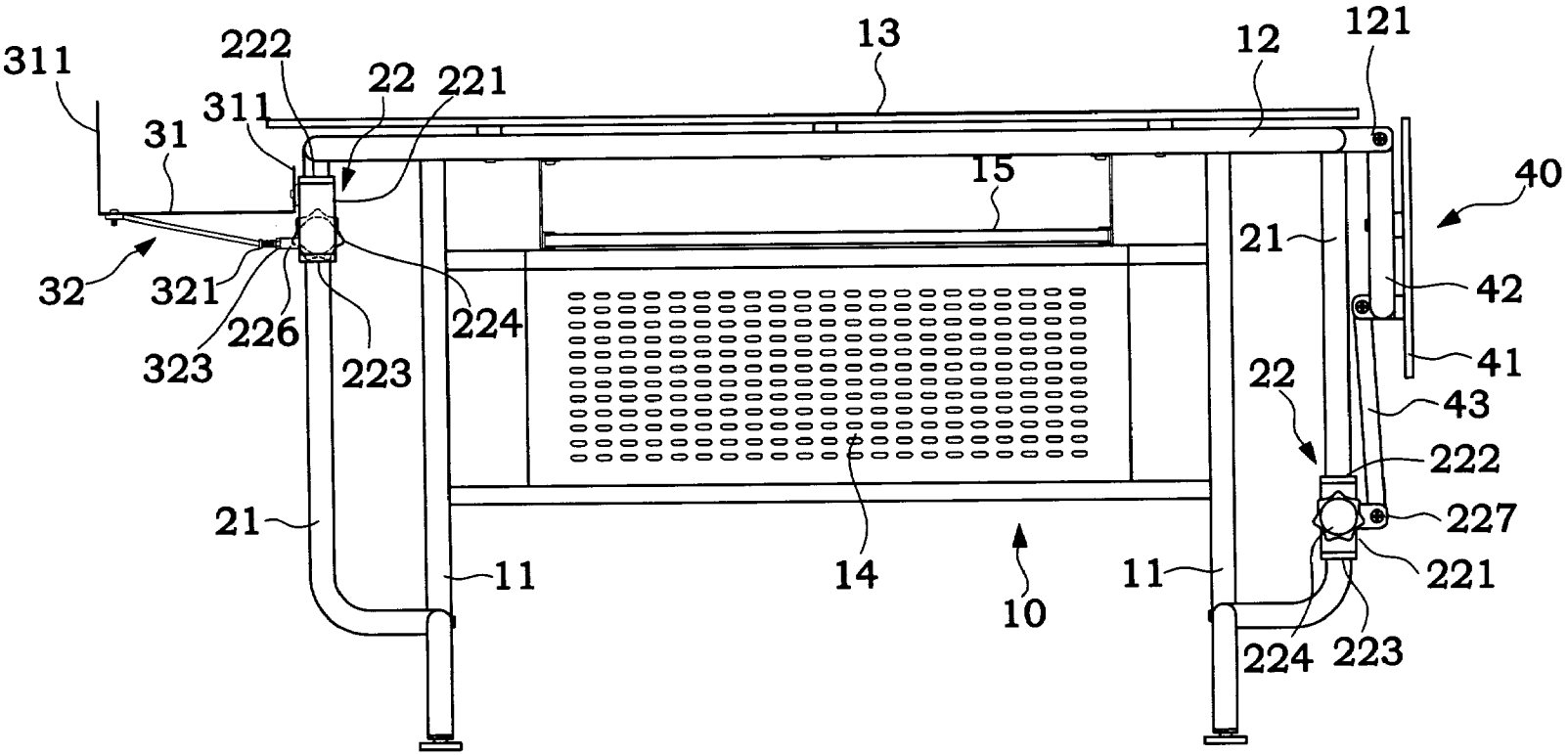
FIG. 5 is another front-view diagram of the assembled structure of the computer desk according to the present invention.

By means of the foregoing structure, as shown in FIGS. 4 and 5, the position of said loading board 31 can be adjusted vertically with the adjusting member 22, and to a desired height depending on the weight of the loading objects, basically not affecting the balance of the main desk. For example, if a larger and heavier object such as a computer is placed on the loading board 31, it is better to adjust the height to a lower position. If a smaller and lighter object is placed on the loading board 31, then the height may be adjusted to a higher position for an easy access and operation.

The side desk 40 can be folded and unfolded by elevating the adjusting member 22. When the adjusting member 22 is shifted downward, the side desk link rod 43 will descend accordingly to drive and fold the side desk downwardly to a side of the main desk 10; on the contrary, when the adjusting member 22 is shifted upward, the side desk link rod will prop the side desk 40 to unfold the side desk horizontally next to the main desk 10.

Figure 7:
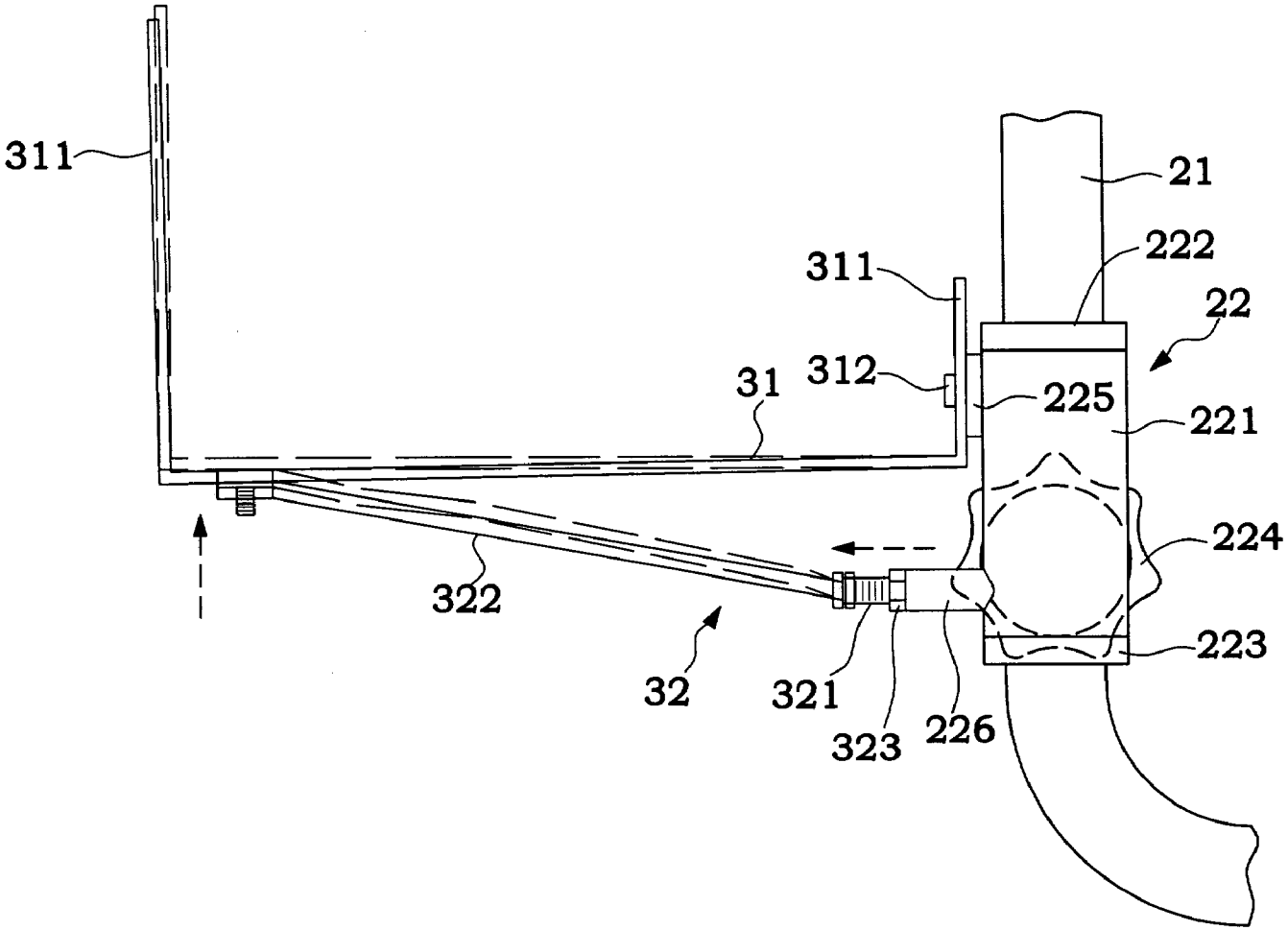
FIG. 7 is an illustrative diagram of fine tuning the supporting stand to improve the inclination of the loading board according to the present invention.

In FIG. 7, when a side of the loading board 31 is slightly tilted downwards after carrying a heavy object for a long time, the nut 323 of the supporting stand 32 can be fine tuned such that the supporting stand 32 slightly shifts outward to support the tilted side of the loading board 31 and keeps the loading board horizontal.

In FIG. 3, the cable bar 50 coils and carries those excessively long cables hung at the back of the main desk 10 to avoid tangled cables and poor appearance.

Users may arrange their computer equipments on the main desk 10, and adjust the height according to the object on the loading board, so that the computer desk in accordance with the present invention has its adjustability and variability. The side desk 40 can also be folded or unfolded according to the user's requirements, providing an expanded desktop area when it is unfolded, and saving space when it is folded. Therefore the side desk also provides the adjustability and variability to the computer desk. The using area of the computer desk can be further expanded after an adjusting member 22 and other loading boards (not shown in the figure) are installed, and thus providing expandability to the computer desk in accordance with this invention. These adjustability, variability, and expandability features allow users to appropriately arrange their computer desk according to the change of computer equipment and application requirements.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A computer desk, comprising:

a main desk;

two side rods, each vertically disposed at a side of said main desk;

two adjusting members, respectively sheathed one each on said two side rods and sliding along said side rods;

securing means disposed on said adjusting members for securing said adjusting members to said side rods;

a loading board, with one end coupled to an upper section of one of said adjusting members;

a supporting stand having a threaded rod on one end and a slightly elevated Y-shape rod on the other end;

a side desk, movably foldably connected to a side of said main desk; and a side desk link rod having one end pivotally coupled to an adjusting member, and the other end pivotally coupled to the bottom of said side desk.

2. The computer desk of claim 1, wherein said main desk has a cable bar.

3. The computer desk of claim 2, wherein said cable bar has a groove section.

4. The computer desk of claim 1, wherein said main desk comprises: a rear board; two side stands, jointly supporting a desktop frame above said side stands; said desktop frame having a desk board; said two side stands at their rear sides being jointly coupled to said rear board; and a keyboard tray capable of moving back and forth under said desktop frame.

5. The computer desk of claim 4, wherein ends of said two side rods are secured onto the bottom of said desktop frame and said side stand.

6. The computer desk of claim 5, further comprising a cable bar wherein said rear board hangs from said cable bar.

7. The computer desk of claim 6, wherein said cable bar comprises a bar structure with a curved cross section, and said curved structure comprises a groove section and a hanging section of said cable bar; with said hanging section hooking said cable bar on the rear board of said main desk.

8. The computer desk of claim 1, wherein said adjusting member comprises a hollow cylinder sheathed onto a side rod, and an adjusting bolt being disposed on the radial direction of said hollow cylinder, and said bolt passing through the body of said hollow cylinder and pressing the internal surface of said hollow cylinder against the body of said side rod.

9. The computer desk of claim 8, wherein said hollow cylinder in its interior has a wear-proof bushing, and said side rod passes through said wear-proof bushing.

10. The computer desk of claim 8, wherein said hollow cylinder at its upper and lower ends each has a wear-proof bushing, and said side rod passes through said wear-proof bushings.

11. The computer desk of claim 1, wherein said adjusting member has a fixed board, and a panel is disposed at a side of said loading board and secured onto said fixed board.

12. The computer desk of claim 1, wherein said side desk comprises: a desk board and a desk frame disposed at the bottom of said desk board.

13. The computer desk of claim 12, wherein said main desk further comprises a pair of hinges, and one of the frame rods of the desk frame of said side desk is pivotally coupled between said hinges with a pivotal element.

14. The computer desk of claim 13, further comprising a pivotal clip and a pivotal element wherein said side desk link rod has one end movably coupled to said pivotal clip outside said adjusting member, and another end movably coupled to a desk frame of said side desk by said pivotal element.

15. The computer desk of claim 1, wherein said supporting stand comprises a through pipe and a threaded rod on one end and a slightly elevated Y-shape rod on the other end; said threaded rod comprising a screw nut being disposed in said through pipe at the external lower section of said adjusting member of the loading board, and the open end of said Y-shape rod secured onto the bottom of said loading board.

* * * * *